US009331415B2

(12) United States Patent
Tagawa

(10) Patent No.: US 9,331,415 B2
(45) Date of Patent: May 3, 2016

(54) ELECTRICAL CONNECTOR

(71) Applicant: Yokowo Co., Ltd., Tokyo (JP)

(72) Inventor: Yoshio Tagawa, Tokyo (JP)

(73) Assignee: YOKOWO CO., LTD., Tokyo (JP)

( * ) Notice: Subject to any disclaimer, the term of this patent is extended or adjusted under 35 U.S.C. 154(b) by 94 days.

(21) Appl. No.: 14/378,702

(22) PCT Filed: Feb. 25, 2013

(86) PCT No.: PCT/JP2013/054672
§ 371 (c)(1),
(2) Date: Oct. 30, 2014

(87) PCT Pub. No.: WO2013/129280
PCT Pub. Date: Sep. 6, 2013

(65) Prior Publication Data

US 2015/0111434 A1 Apr. 23, 2015

(30) Foreign Application Priority Data

Mar. 2, 2012 (JP) ..... 2012-047410

(51) Int. Cl.
*H01R 24/00* (2011.01)
*H01R 13/24* (2006.01)
(Continued)

(52) U.S. Cl.
CPC ..... *H01R 13/2442* (2013.01); *H01R 12/55* (2013.01); *H01R 12/716* (2013.01)

(58) Field of Classification Search
CPC .... H01R 13/2442; H01R 13/24; H01R 12/55; H01R 12/716; H01R 12/71
USPC ..... 439/626, 66, 65, 79, 80
See application file for complete search history.

(56) References Cited

U.S. PATENT DOCUMENTS 6,000,969 A 12/1999 Reichardt et al.
7,059,893 B2 * 6/2006 Ono ..... H01R 12/592 439/260
2002/0081915 A1 6/2002 Igarashi et al.

FOREIGN PATENT DOCUMENTS

CN 1221236 A 6/1999
CN 201041855 Y 3/2008
(Continued)

OTHER PUBLICATIONS

Japanese Patent Office; International Search Report in International Patent Application No. PCT/JP2013/054672 dated May 28, 2013.
(Continued)

*Primary Examiner* — Javaid Nasri
(74) *Attorney, Agent, or Firm* — Leydig, Voit & Mayer, Ltd.

(57) ABSTRACT

An electrical connector allowing a housing and a contact portion to be displaced relative to a mounting circuit board, parallel to a board surface, without a reinforcing plate separate from a contact member. A basal portion of a contact member is present along an upper surface of a base portion of a housing. A mounting-side elastic portion of the contact member is present along a lower surface of the base portion of the housing. A folding-back portion of the contact member is located at a rear of the base portion of the housing to connect the basal portion to the mounting-side elastic portion. First and second connecting leg portions extend downward from the mounting-side elastic portion. Each tip side of the leg portions acts as a mounting portion for a circuit board at positions different from each other in a front-back direction.

13 Claims, 9 Drawing Sheets

(51) Int. Cl.
*H01R 12/55* (2011.01)
*H01R 12/71* (2011.01)

(56) References Cited

FOREIGN PATENT DOCUMENTS

| | | | |
|---|---|---|---|
| JP | 10-92526 | A | 4/1998 |
| JP | 2001-502837 | A | 2/2001 |
| JP | 2002-198113 | A | 7/2002 |
| JP | 2010-118314 | A | 5/2010 |
| WO | WO 97/45900 | A1 | 12/1997 |

OTHER PUBLICATIONS

State Intellectual Property Office of the People'S Republic of China; Office Action in Chinese Patent Application No. 201380012050.5 (Dec. 31, 2015).

* cited by examiner

ELECTRICAL CONNECTOR

TECHNICAL FIELD

The present invention relates to an electrical connector usable for a battery pack connecting portion of a portable video device etc., for example, and floatable on a mounting board.

BACKGROUND ART

An electrical connector is made up of a housing and a contact member and is mounted on a circuit board to elastically support a contact portion coming into contact with, for example, a terminal of a battery, at a predetermined position. For this type of electrical connector, a technique is known that provides a floating function allowing the housing and the contact portion to be displaced relative to the mounting circuit board in parallel with a board surface (see Patent Document 1). According to the floating function, a position gap tolerance between a case and the board can be absorbed in an assembly process of an end product. For example, when the same electrical connector is diverted to a different model etc., if the mounting position of the electrical connector must be shifted on a board while the same position of the contact portion is maintained, the same electrical connector is usable given that an amount of shift is within a displaceable range from the floating function. The same applies to when the position of the contact portion must be shifted without changing the mounting position of the electrical connector on the board.

PRIOR ART DOCUMENT

Patent Document

[Patent Document 1] Japanese Laid-Open Patent Publication No. 2010-118314

SUMMARY OF THE INVENTION

Problem to be Solved by the Invention

The electrical connector of Patent Document 1 is configured such that "the electrical connector includes a housing 10 made of a single member and a contact member 20 fixed to the housing 10. The contact member 20 has a solder connecting portion 21 connected to a circuit board, an elastic portion 22 extending upward from the solder connecting portion 21 and folding back toward the housing 10 to extend downward, a fixing portion 23 that has one end 231 connected to a tip 222 of the elastic portion 22 extending downward and that extends in horizontal direction to be fixed to the vicinity of a bottom surface of the housing 10, and a contact portion 24 extending upward from the other end 232 opposed to the one end 231 of the fixing portion 23" (see [Abstract] of Patent Document 1), so as to realize the floating function with the elastic portion 22. However, since one contact is soldered to the board at only one position on the rear side of the housing, a reinforcing plate (solder peg 30) is substantially essential that is soldered to the board separately from the contact, increasing a parts count and assembly man-hours. Since the reinforcing plate must have elasticity for the floating function and has a complicated shape and a larger size as compared to a typical reinforcing plate and a displacement space must be ensured for the reinforcing plate, the electrical connector disadvantageously increases in size as a whole.

The present invention was conceived in view of the situations and it is therefore an object of the present invention to provide an electrical connector allowing a housing and a contact portion to be displaced relative to a mounting board in parallel with a board surface without disposing a reinforcing plate separately from a contact member.

Means for Solving the Problem

An aspect of the present invention is an electrical connector. The electrical connector comprises:

- an insulating housing; and
- a conductive contact member, wherein,
  - when a direction toward a mounting object board is downward, the contact member has
    - a basal portion fixed to the housing,
    - a contact-side elastic portion rising from the basal portion and having a contact portion,
    - first and second connecting leg portions, each tip side of which acts as mounting portion for the board at positions different from each other, and
    - a mounting-side elastic portion disposed between the basal portion and the first and second connecting leg portions, and
  - the housing has a convex portion formed on a lower surface thereof, wherein
    - a cover portion facing the lower surface of the housing extends from the convex portion, and
    - a portion of the first connecting leg portion is inserted in a gap between the lower surface of the housing and the cover portion.

The mounting-side elastic portion may be present on the lower surface side of the housing, and the contact member may have a folding-back portion located outside of the lower surface of the housing to connect one end of the mounting-side elastic portion and the basal portion.

Another aspect of the present invention is an electrical connector. The electrical connector comprises:

- an insulating housing; and
- a conductive contact member, wherein,
  - when a direction toward a mounting object board is downward, the contact member has
    - a basal portion fixed to the housing,
    - a contact-side elastic portion rising from the basal portion and having a contact portion,
    - a mounting-side elastic portion present on the lower surface side of the housing,
    - a folding-back portion located outside of the lower surface of the housing to connect one end of the mounting-side elastic portion and the basal portion, and
    - first and second connecting leg portions both extending downward from the other end of the mounting-side elastic portion, wherein each tip side of the leg portions acts as mounting portion for the board at positions different from each other.

The mounting-side elastic portion may have structure displaceable in front-back direction and left-right direction without displacement in up-down direction.

The mounting-side elastic portion may have a first U-shaped portion extending in the front-back direction and a second U-shaped portion extending in the left-right direction.

One housing may be provided with a plurality of the contact members aligned and held in the left-right direction with a partition wall portion interposed therebetween, and the second U-shaped portion of each of the contact members may be shorter than the first U-shaped portion and be located on the rear side relative to a center position of the housing in the front-back direction.

One housing may be provided with a plurality of the contact members aligned and held in the left-right direction with a partition wall portion interposed therebetween, and the first and second connecting leg portions of each of the contact members may have the mounting portions for the board separated in the front-back direction.

A convex portion may be formed on the lower surface of a base portion of the housing, and the convex portion may come into contact with the first and second connecting leg portions to restrict an elastic deformation amount of the mounting-side elastic portion.

It is to be noted that any arbitrary combination of the above-described structural components as well as the expressions according to the present invention changed among a system and so forth are all effective as and encompassed by the present aspects.

Effect of the Invention

According to the present invention, since the contact member has first and second connecting leg portions acting as mounting portions for the mounting board at positions different from each other on the tip side, the electrical connector can be realized that allows the housing and the contact portion to be displaced relative to the mounting board in parallel with the board surface without disposing a reinforcing plate separately from the contact member.

EMBODIMENT FOR CARRYING OUT THE INVENTION

The invention will now be described based on the following embodiments which do not intend to limit the scope of the present invention but exemplify the invention. All of the features and the combinations thereof described in the embodiments are not necessarily essential to the invention.

Figure 1:
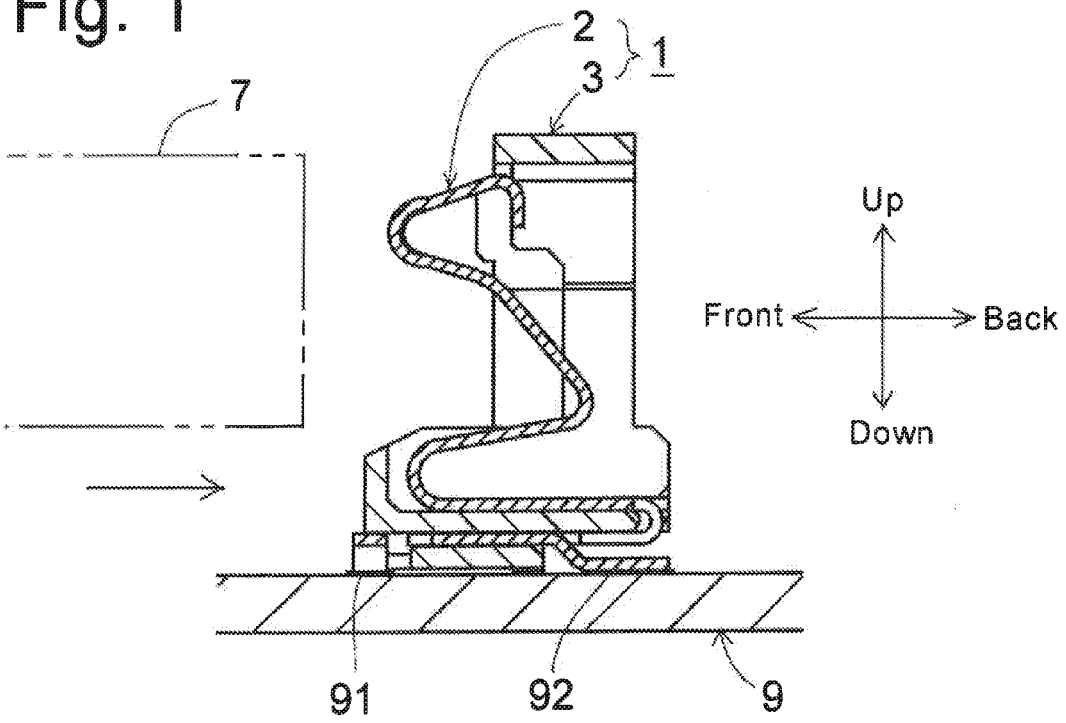
FIG. 1 is a right-side cross-sectional view of an electrical connector 1 according to a first embodiment of the present invention in a mounted state on a circuit board 9.
Figure 2:
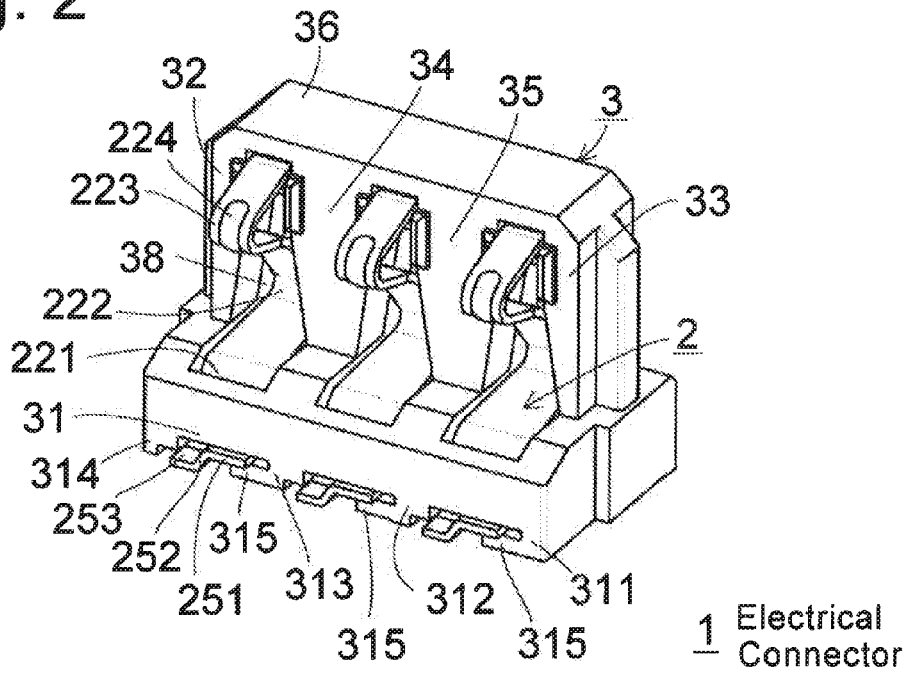
FIG. 2 is a perspective view (part one) of the electrical connector 1.
Figure 3:
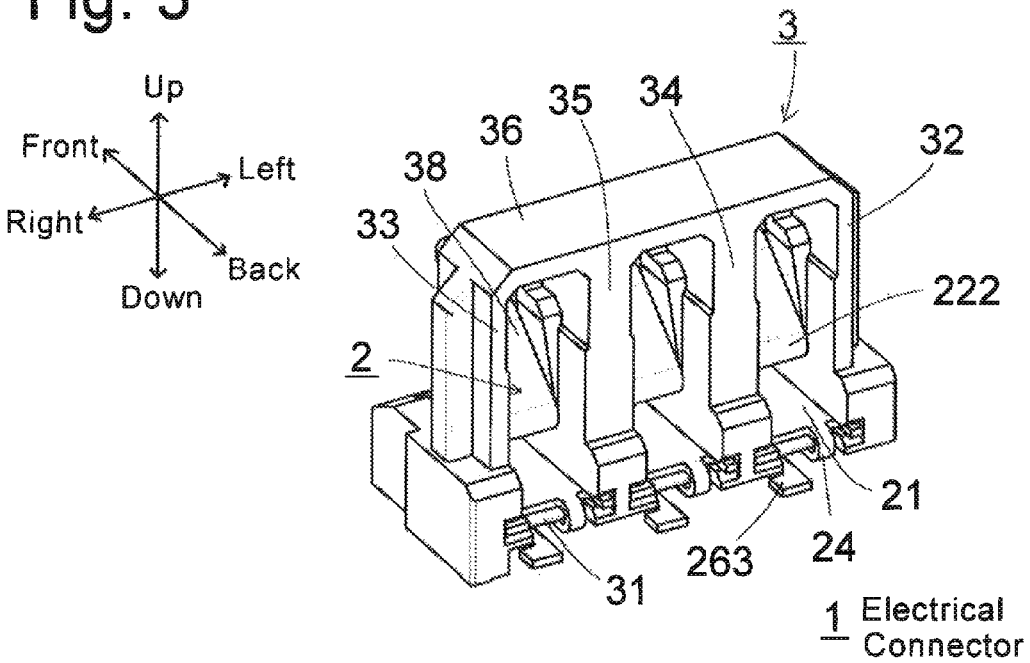
FIG. 3 is a perspective view (part two) of the electrical connector 1.
Figure 4:
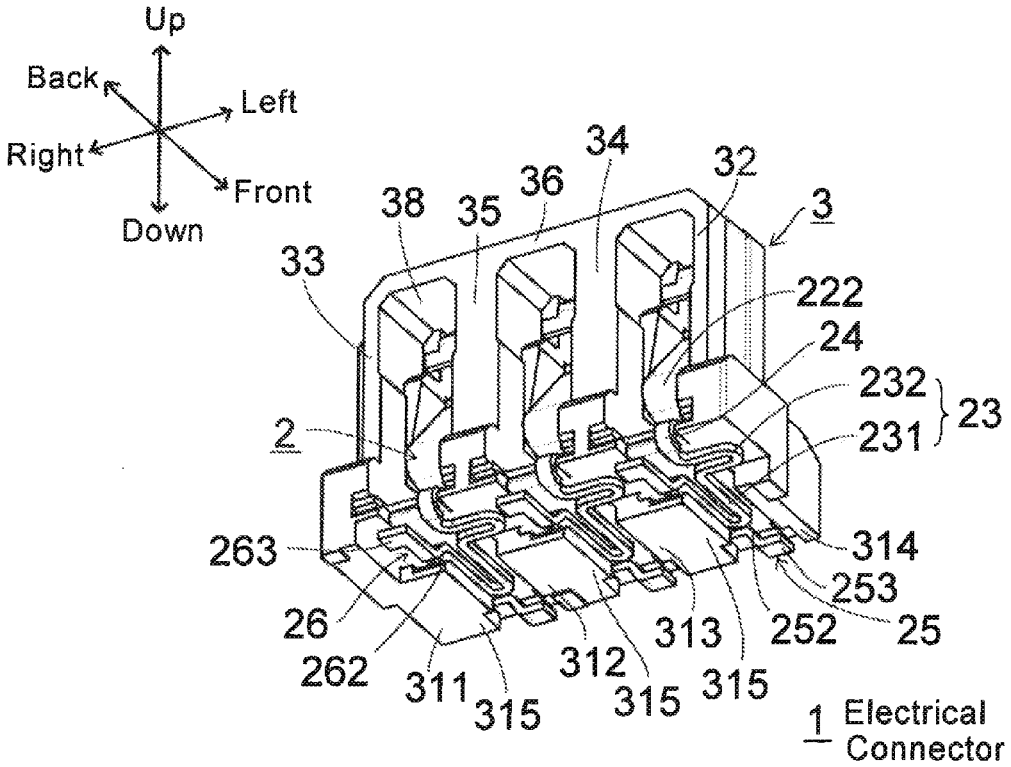
FIG. 4 is a perspective view (part three) of the electrical connector 1.
Figure 5:
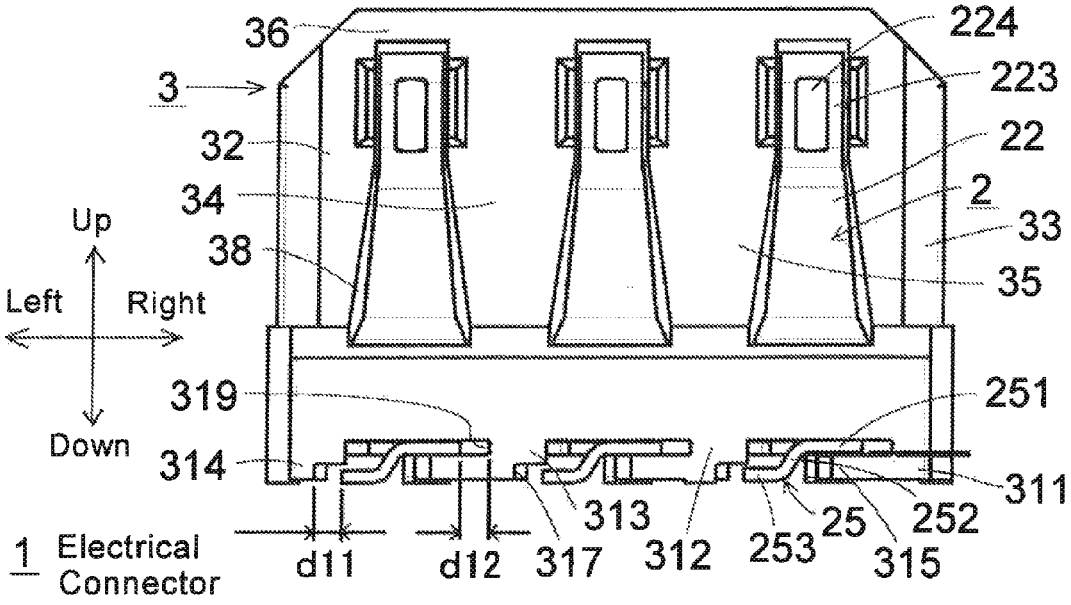
FIG. 5 is a front view of the electrical connector 1.
Figure 6:
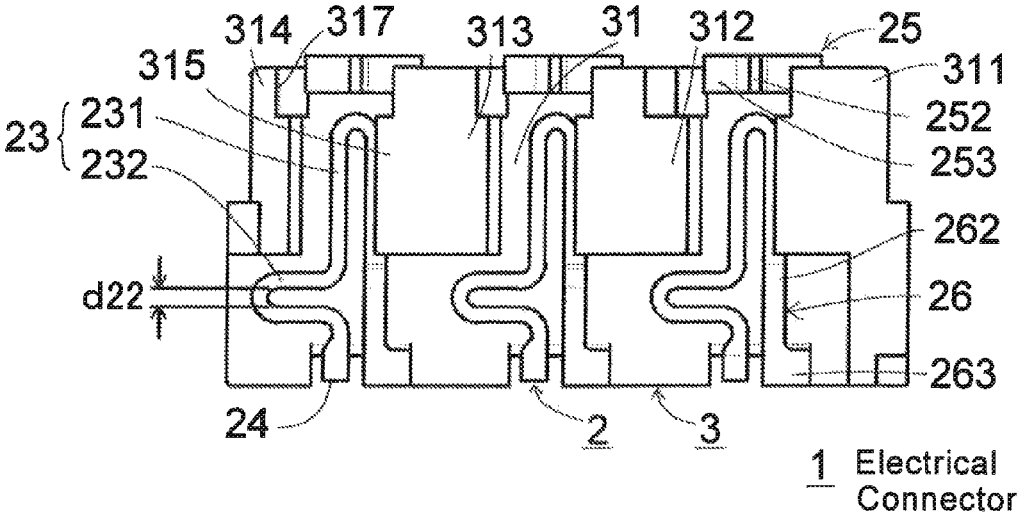
FIG. 6 is a bottom view of the electrical connector 1.
Figure 7:
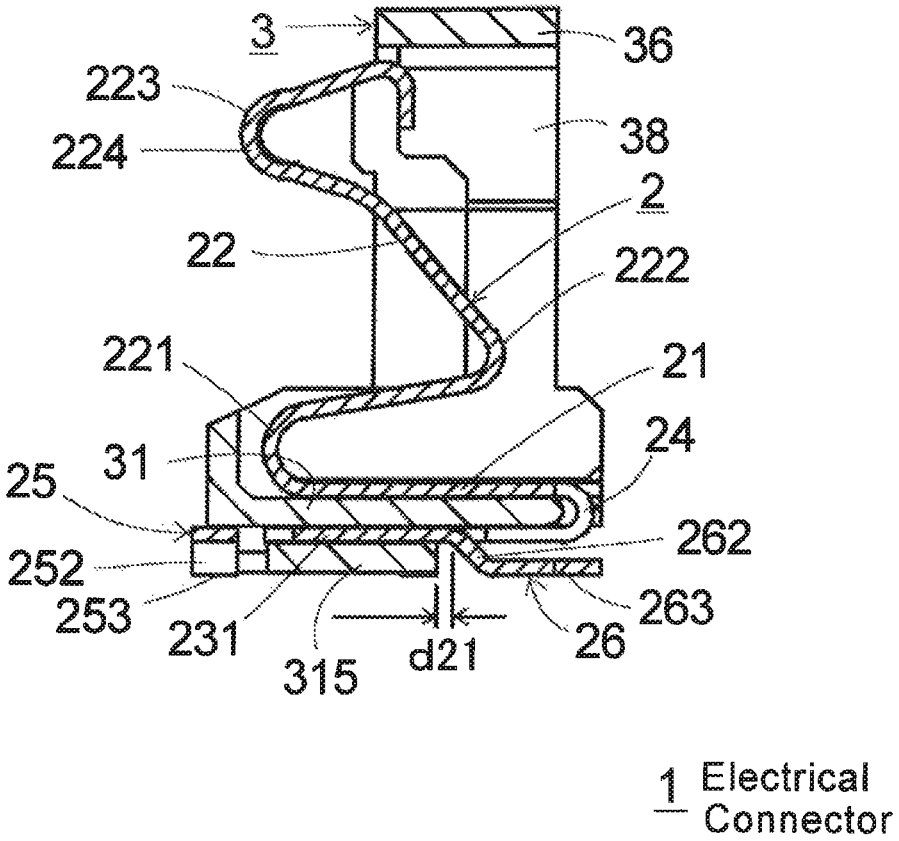
FIG. 7 is a right-side cross-sectional view of the electrical connector 1.
Figure 8:
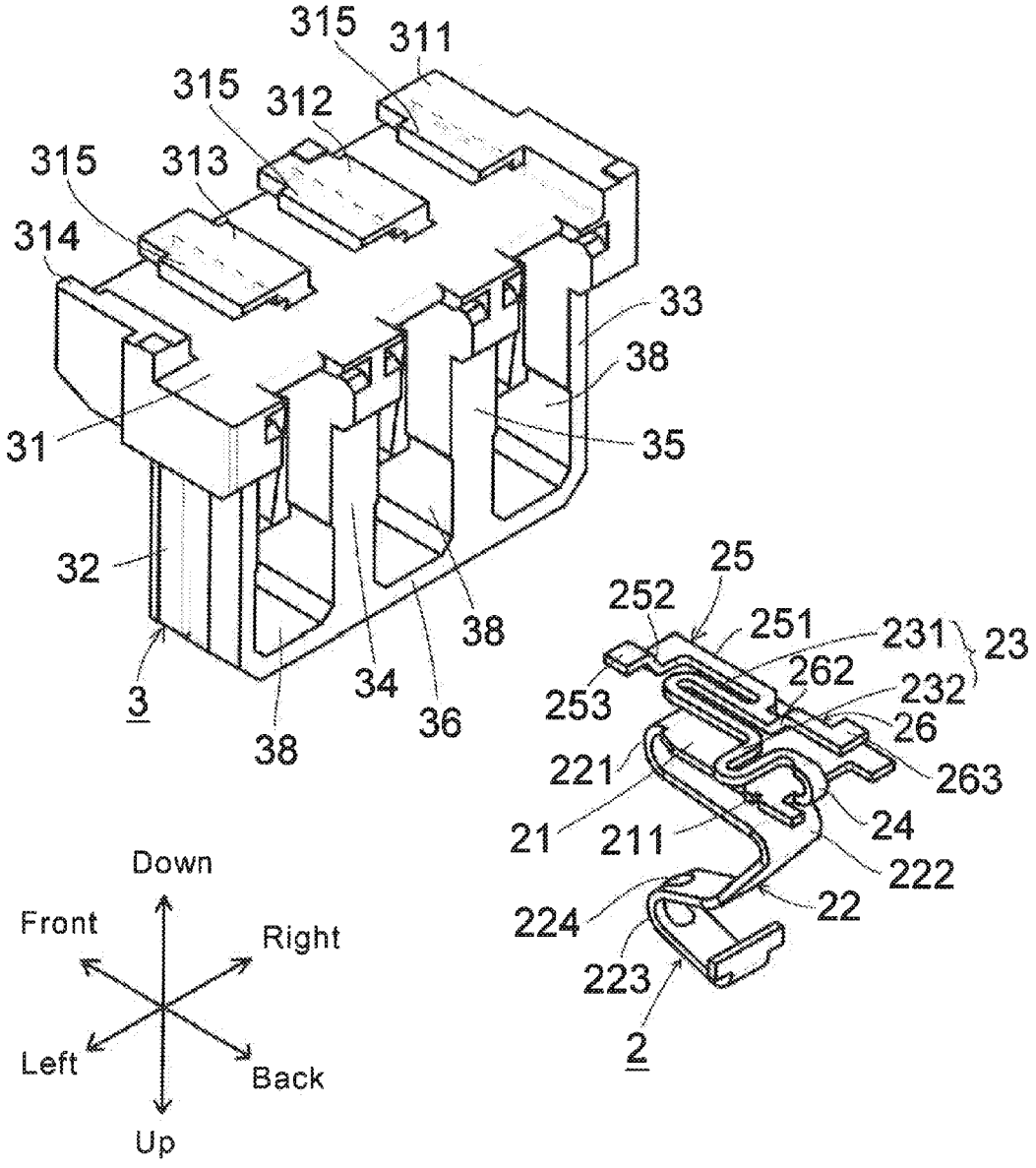
FIG. 8 is an exploded perspective view (part one) of the electrical connector 1.
Figure 9:
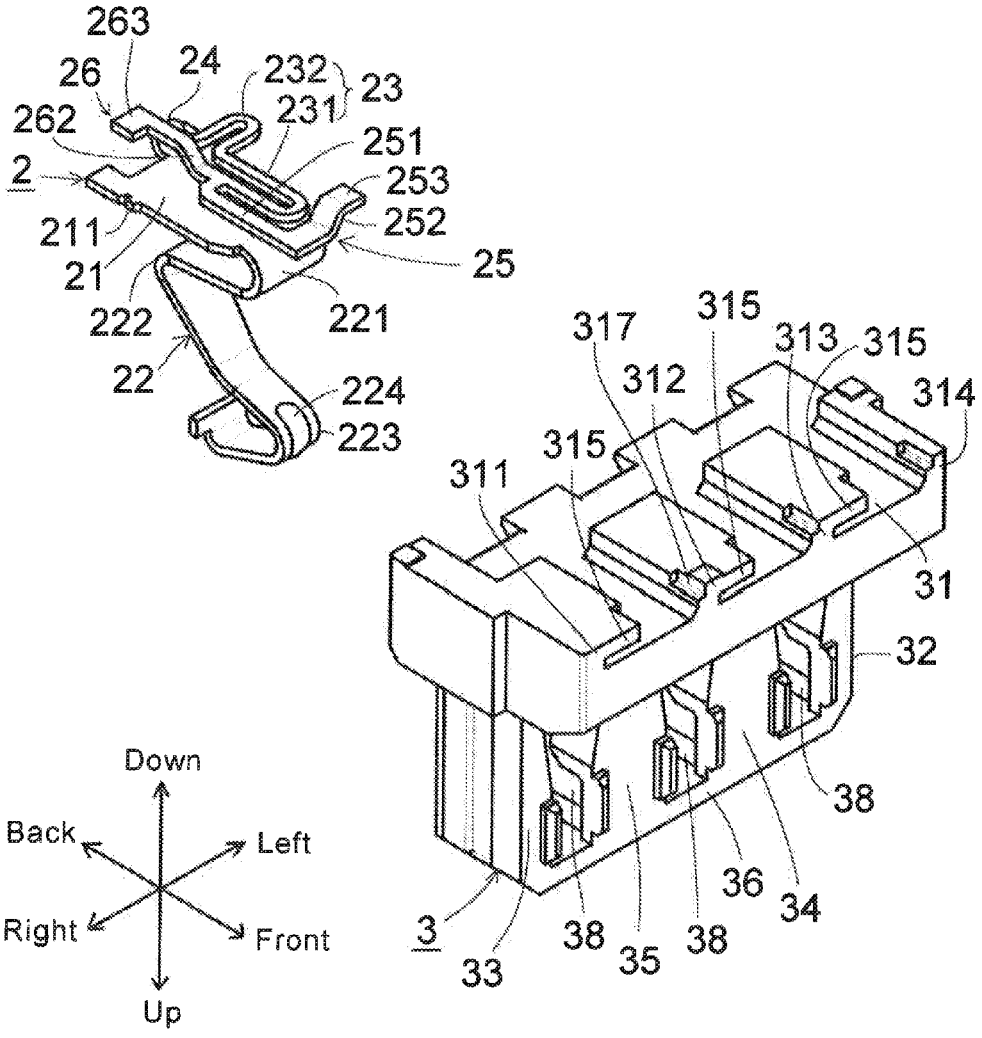
FIG. 9 is an exploded perspective view (part two) of the electrical connector 1.

FIG. 1 is a right-side cross-sectional view of an electrical connector 1 according to a first embodiment of the present invention in a mounted state on a circuit board 9. FIGS. 2 to 4 are perspective views of the electrical connector 1. FIG. 5 is a front view of the electrical connector 1. FIG. 6 is a bottom view of the electrical connector 1. FIG. 7 is a right-side cross-sectional view of the electrical connector 1. FIGS. 8 and 9 are exploded perspective views of the electrical connector 1. These figures define three orthogonal directions, i.e., front-back, up-down, and left-right directions.

The electrical connector 1 includes a conductive contact member 2 and an insulating housing 3. For example, the housing 3 is an integral resin molded product and the contact member 2 is an integral metal plate. As depicted in FIG. 1, the contact member 2 is surface-mounted by soldering to two solder connecting portions 91, 92 on a circuit board 9. An object to be connected, for example, a battery 7 is connected to the electrical connector 1 from the front side in this embodiment. As a result, an electrode (not depicted) of the battery 7 is electrically connected via the electrical connector 1 to a conductive pattern (not depicted) of the circuit board 9.

Single structure of the contact member 2 and the housing 3 will first be described mainly with reference to FIGS. 8 and 9.

The housing 3 has a base portion 31, side wall portions 32, 33, partition wall portions 34, 35, and a ceiling portion 36 and these portions form three hole portions 38 such that a portion of the contact member 2 is housed in each of the hole portions 38. The side wall portions 32, 33 rise from both left and right ends of the base portion 31. The partition wall portions 34, 35 rise from the base portion 31 between the side wall portions 32, 33. The ceiling portion 36 is located between upper ends of the side wall portions 32, 33 across upper ends of the partition wall portions 34, 35. Convex portions 311 to 314 projected downward are formed on a lower surface of the base portion 31. Respective cover portions 315 facing the lower surface of the base portion 31 extend from tip portions of the convex portions 311 to 313. Front end portions of right side surfaces of the convex portions 312 to 314 are formed as stepped wall portions 317 (FIG. 9). The stepped wall portions 317 define a rightward maximum allowable displacement distance d11 (FIG. 5) of the housing 3 as described later.

The contact member 2 has a basal portion 21, a contact-side elastic portion 22, a mounting-side elastic portion 23, a folding-back portion 24, and first and second connecting leg portions 25, 26. The basal portion 21 has a planar shape extending in a horizontal plane (in a plane at the same position in the up-down direction). Structure of the contact member 2 upper than the basal portion 21 is known and therefore will briefly be described. The contact-side elastic portion 22 has a shape that extends backward and upward from a folding portion 221 at the front end of the basal portion 21, that is folded back at a folding portion 222 on the rear side to extend forward and upward, and that is further folded backward at a folding portion 223 on the front side. A contact portion 224 convexed toward the front side and facing forward is formed on the folding portion 223 by press working, for example. If an electrode of the object to be connected is pressed against the contact portion 224 from the front side, the contact portion 224 is retracted due to elastic deformation of the contact-side elastic portion 22.

In the contact member 2, the mounting-side elastic portion 23 extends on the lower side of the basal portion 21 in parallel with the basal portion 21. One end of the mounting-side elastic portion 23 and the rear end of the basal portion 21 are connected by the folding-back portion 24 (folding portion). The first and second connecting leg portions 25, 26 both extend downward from the other end of the mounting-side elastic portion 23. Each tip side of the leg portions 25, 26 acts as mounting portion for the circuit board 9 (FIG. 1) at positions different from each other, which are positions separated in the front-back direction in this embodiment.

The mounting-side elastic portion 23 includes a first U-shaped portion 231 extending in the front-back direction and a second U-shaped portion 232 extending in the left-right direction. One end of the second U-shaped portion 232 is connected to the folding-back portion 24 while one end of the first U-shaped portion 231 is connected to the other end of the second U-shaped portion 232, and the first and second connecting leg portions 25, 26 separately extend in the respective front-back directions from the other end of the first U-shaped portion 231. A length of the first U-shaped portion 231 in the front-back direction is longer than a length of the second U-shaped portion 232 in the left-right direction.

The first connecting leg portion 25 is a leg portion extending forward from the other end of the first U-shaped portion 231 and has a stored portion 251, a first bent-up portion 252, and a first surface mounting portion 253. The stored portion 251 extends from the other end of the first U-shaped portion 231 and extends forward on the side (right side) of the first U-shaped portion 231. The first surface mounting portion 253 is a tip portion of the first connecting leg portion 25 and is surface-mounted on the circuit board 9 (FIG. 1) by soldering, for example. The first surface mounting portion 253 has an area capable of ensuring solder joint strength sufficient for surface mounting. The first bent-up portion 252 is portion connected to the front end side of the stored portion 251 by bending up a right end of the first surface mounting portion 253.

The second connecting leg portion 26 is a leg portion extending backward from the other end of the first U-shaped portion 231 and has a second bent-up portion 262 and a second surface mounting portion 263. The second surface mounting portion 263 is a tip portion of the second connecting leg portion 26 and is surface-mounted on the circuit board 9 (FIG. 1) by soldering, for example. The second surface mounting portion 263 has an area capable of ensuring solder joint strength sufficient for surface mounting. The second bent-up portion 262 is portion connected to the other end of the first U-shaped portion 231 by bending up the front end of the second surface mounting portion 263.

Combined structure of the contact member 2 and the housing 3 will then be described mainly with reference to FIGS. 2 to 7.

The contact member 2 is assembled to the housing 3 from the rear side such that the base portion 31 of the housing 3 is interposed between the basal portion 21 and the mounting-side elastic portion 23 while the basal portion 21 and the contact-side elastic portion 22 are put through the hole portion 38 of the housing 3. Since fixing claws 211 (FIGS. 8, 9) formed on the side edges (both edges) of the basal portion 21 enter the hole portion 38 to scrape the inner walls of the hole portions 38 and the fixing claws 211 bite into the inner walls of the hole portions 38, the basal portion 21 is fixed to the housing 3 after assembling. A plurality (three in this embodiment) of the contact members 2 of the same shape is assembled to the single housing 3.

The basal portion 21 of the contact member 2 is present along the upper surface of the base portion 31 of the housing 3. The mounting-side elastic portion 23 of the contact member 2 is present along the lower surface of the base portion 31 of the housing 3. The folding-back portion 24 of the contact member 2 is located at the rear of the base portion 31 of the housing 3 to connect the basal portion 21 and the mounting-side elastic portion 23. The stored portion 251 of the first connecting leg portion 25 and a portion on the right side of the first U-shaped portion 231 of the contact member 2 are located (inserted) in a gap (terminal storage slit) between the lower surface of the base portion 31 and the cover portion 315 of the housing 3.

The distance d11 (FIG. 5) between a side edge (left edge) of the first surface mounting portion 253 of the contact member 2 and the facing convex portion on the left side (the stepped wall portion 317 of the convex portion 312 to 314 of the housing 3) is the rightward maximum allowable displacement distance of the housing 3 relative to the first surface mounting portion 253 (i.e., the mounting circuit board). In particular, if the housing 3 moves rightward by the distance d11 relative to the first surface mounting portion 253, the side edge (left edge) of the first surface mounting portion 253 comes into contact with the stepped wall portion 317 of the convex portions 312 to 314 of the housing 3 to restrict the rightward displacement of the housing 3 equal to or smaller than the distance d11.

A distance d12 (FIG. 5) between a side edge (right edge) of the stored portion 251 of the contact member 2 and the facing convex portion on the right side (the convex portion 311 to 313 of the housing 3, i.e., a bottom surface 319 of the terminal storage slit) is the leftward maximum allowable displacement distance of the housing 3 relative to the first surface mounting portion 253 (i.e., the mounting circuit board). In particular, if the housing 3 moves leftward by the distance d12 relative to the first surface mounting portion 253, the side edge (right edge) of the stored portion 251 comes into contact with the convex portion 311 to 313 of the housing 3, i.e., the bottom surface 319 of the terminal storage slit, to restrict the leftward displacement of the housing 3 equal to or smaller than the distance d12.

A distance d21 between a front surface of the second bent-up portion 262 of the contact member 2 (a front surface of a portion extending forward and obliquely upward from the second surface mounting portion 263) and a rear end surface of the cover portion 315 of the housing 3 is the backward maximum allowable displacement distance of the housing 3 relative to the second surface mounting portion 263 (i.e., the mounting circuit board). In particular, if the housing 3 moves backward by the distance d21 relative to the second surface mounting portion 263, the front surface of the second bent-up portion 262 comes into contact with the rear end surface of the cover portion 315 to restrict the backward displacement of the housing 3 equal to or smaller than the distance d21.

The forward displacement of the housing 3 relative to the mounting circuit board is not restricted by contact with the contact member 2. However, when the second U-shaped portion 232 is compressed by a maximum compression distance d22 (FIG. 6) due to the forward displacement of the housing 3, elastic resistance of the elastic portion 22 subsequently increases to substantially restrict further forward displacement of the housing 3.

Operation of the floating function in the electrical connector 1 will hereinafter be described.

FIGS. 10 to 13 are bottom views of the electrical connector 1 when forward, backward, leftward, and rightward forces are applied to the housing 3, and FIGS. 10, 11, 12, and 13 depict the cases of application of rightward force, leftward force backward force, and forward force, respectively. In FIGS. 10 to 13, it is assumed that the first and second surface mounting portions 253, 263 are fixed to a circuit board not depicted and are immobile relative to the circuit board.

Figure 10:
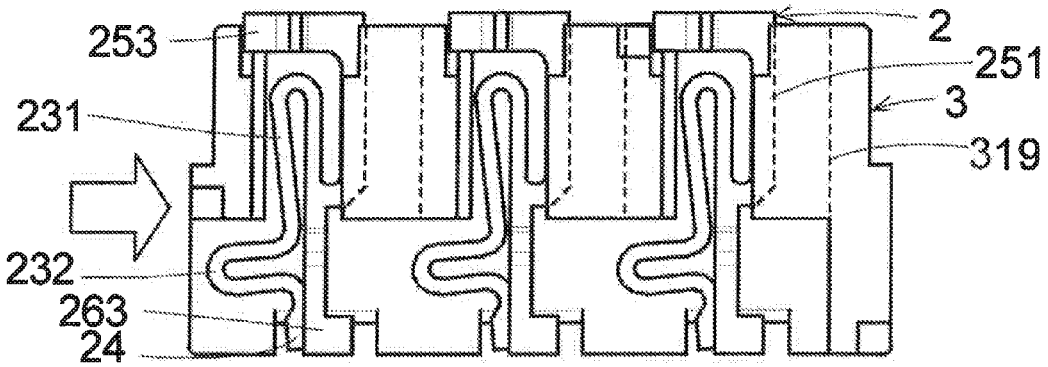
FIG. 10 is a bottom view of the electrical connector 1 when rightward force is applied to a housing 3.
Figure 11:
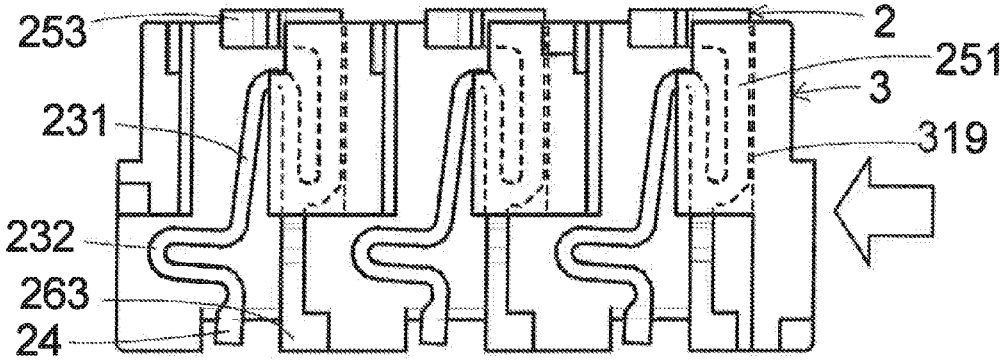
FIG. 11 is a bottom view of the electrical connector 1 when leftward force is applied to the housing 3.
Figure 12:
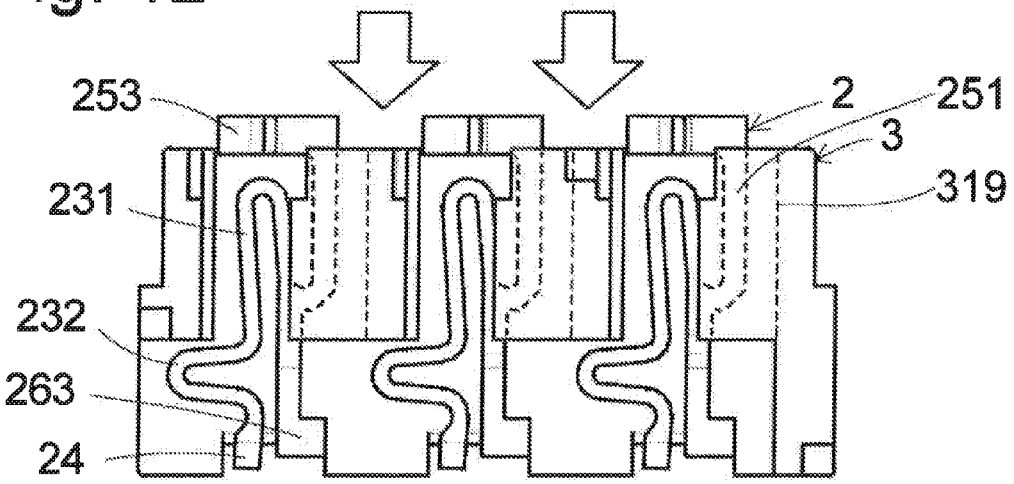
FIG. 12 is a bottom view of the electrical connector 1 when backward force is applied to the housing 3.
Figure 13:
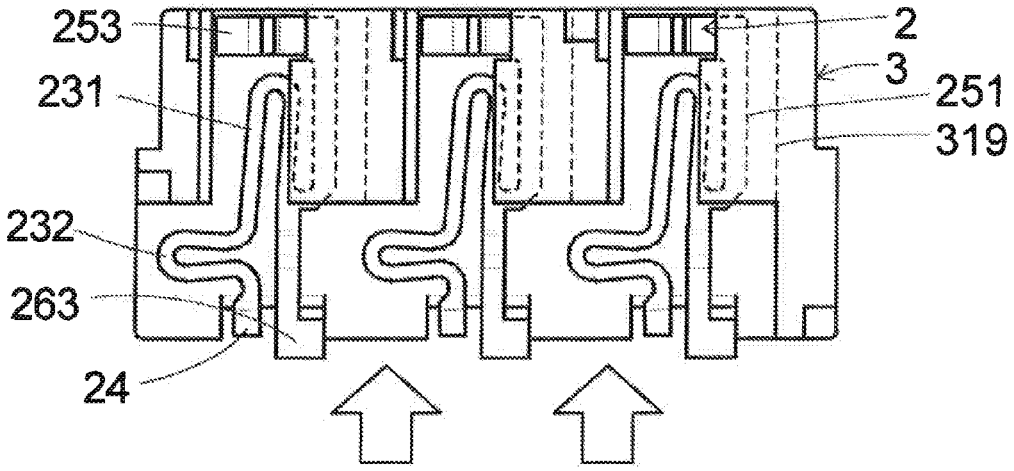
FIG. 13 is a bottom view of the electrical connector 1 when forward force is applied to the housing 3.

As depicted in FIG. 10, if rightward force is applied to the housing 3, the first U-shaped portion 231 is compressed (closed) and, therefore, the housing 3 can be displaced rightward relative to the first and second surface mounting portions 253, 263 (i.e., the mounting circuit board). As depicted in FIG. 11, if leftward force is applied to the housing 3, the first U-shaped portion 231 is expanded (opened) and, therefore, the housing 3 can be displaced leftward relative to the first and second surface mounting portions 253, 263. As depicted in FIG. 12, if backward force is applied to the housing 3, the second U-shaped portion 232 is expanded (opened) and, therefore, the housing 3 can be displaced backward relative to the first and second surface mounting portions 253, 263. In this case, since the second U-shaped portion 232 is shorter than the first U-shaped portion 231, if only the expansion and compression of the second U-shaped portion 232 are used, stronger resistance is generated against the forward and backward displacement of the housing 3 (the displacement becomes more difficult) as compared to the leftward and rightward displacement. However, since the housing 3 can be displaced backward not only by opening of the second U-shaped portion 232 but also by swinging (leftward tilting) of the first U-shaped portion 231 longer than the second U-shaped portion 232, the resistance at the time of the backward displacement is reduced. As depicted in FIG. 13, if forward force is applied to the housing 3, the second U-shaped portion 232 is compressed (closed) and, therefore, the housing 3 can be displaced forward relative to the first and second surface mounting portions 253, 263. Since the housing 3 can be displaced forward not only by closing of the second U-shaped portion 232 but also by swinging (rightward tilting) of the first U-shaped portion 231 longer than the second U-shaped portion 232, the resistance at the time of the forward displacement is reduced. By combining displacements in two directions, diagonal and rotational displacements can be accommodated.

According to the embodiment, the following effects are produced.

(1) Since the contact member 2 has the first and second connecting leg portions 25, 26 both extending downward from the other end of the mounting-side elastic portion 23 and each tip side of the leg portions 25,26 acts as mounting portion for the circuit board at positions separated in the front-back direction, it is not necessary to separately dispose a reinforcing plate along with the contact member 2 unlike the case of soldering the contact member to the board at only one position on the rear side of the housing as in the conventional case. This eliminates increases in parts count and assembly man-hours due to the disposition of the reinforcing plate. To ensure the floating function while the reinforcing plate is used, the reinforcing plate must have elasticity, resulting in a complicated shape and a larger size as compared to a typical reinforcing plate, and a displacement space must be ensured for the reinforcing plate; on the other hand, since this embodiment requires no reinforcing plate, the size and cost of the electrical connector are reduced as a whole as compared to the conventional case using the reinforcing plate.

(2) Since the stored portion 251 of the first connecting leg portion 25 of the contact member 2 is always housed in a gap (the terminal storage slit) between the lower surface of the base portion 31 and the cover portion 315 of the housing 3, when force is applied to the housing 3 in a direction of detachment from the board, the cover portion 315 is hooked to the stored portion 251 of the first connecting leg portion 25 of the contact member 2 and, therefore, the housing 3 can be prevented from being separated from the contact member 2 and being detached from the board without using another component. Although the reinforcing plate conventionally plays a role in this detachment prevention, this embodiment can prevent the detachment of the housing 3 without using the reinforcing plate.

(3) The contact member 2 and the housing 3 have an excessive displacement preventing function by its own in terms of the forward, backward, leftward, and rightward directions and can prevent excessive deformation or breakage of the contact member 2 (particularly, the mounting-side elastic portion 23) due to excessive displacement without using another component. Although the reinforcing plate conventionally plays a role in this excessive displacement prevention, this embodiment can prevent the excessive displacement without using the reinforcing plate.

(4) Since the mounting-side elastic portion 23 of the contact member 2 is disposed on the lower surface side of the base portion 31 of the housing 3, the mounting-side elastic portion 23 can be made up of the first U-shaped portion 231 extending in the front-back direction and the second U-shaped portion 232 extending in the left-right direction. The first and second U-shaped portions 231, 232 are elastically deformable without torsion and can easily be displaced in the front-back and left-right directions without displacement in the up-down direction unlike a conventional configuration displaced in the left-right direction through torsional deformation of an elastic portion. Since the second U-shaped portion 232 extending in the left-right direction is made shorter than the first U-shaped portion 231 extending in the front-back direction, the swinging of the first U-shaped portion 231 having a longer length can be used for complementing the displacement in the front-back direction, which is associated with larger resistance because of a shorter length when only the elastic deformation of the second U-shaped portion 232 is used, while reducing an arrangement interval of the contact members 2 aligning in the left-right direction, and the resistance can be decreased at the time of the displacement in the front-back direction.

Figure 14:
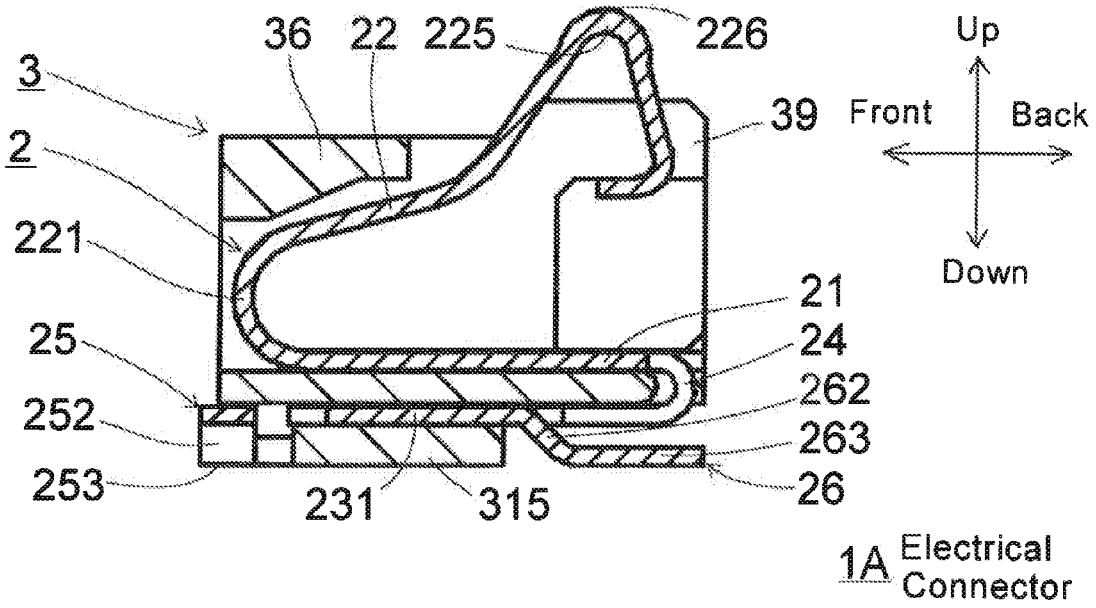
FIG. 14 is a right-side cross-sectional view of an electrical connector 1A according to a second embodiment of the present invention.
Figure 15:
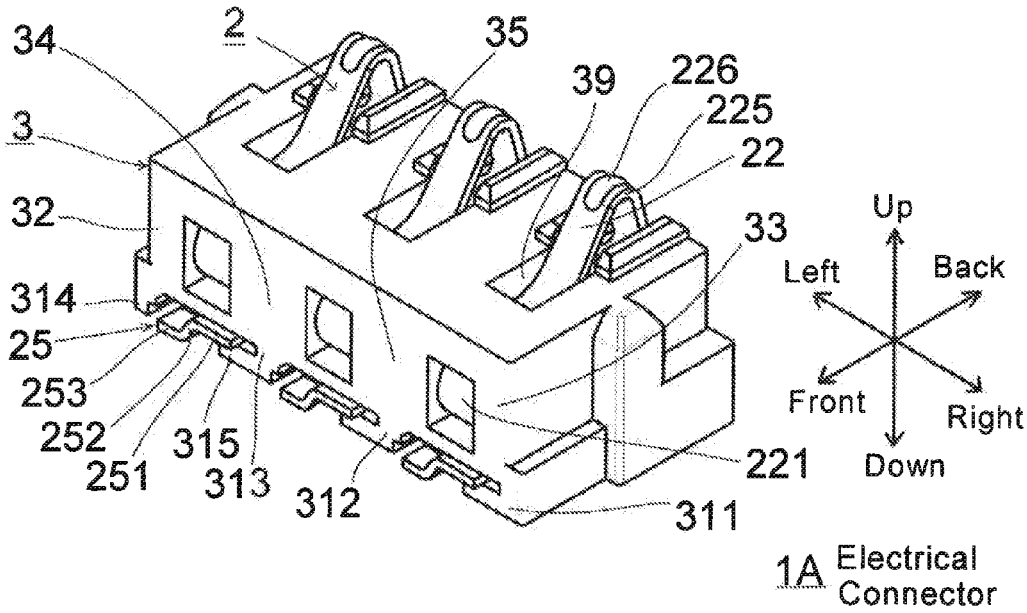
FIG. 15 is a perspective view (part one) of the electrical connector 1A.
Figure 16:
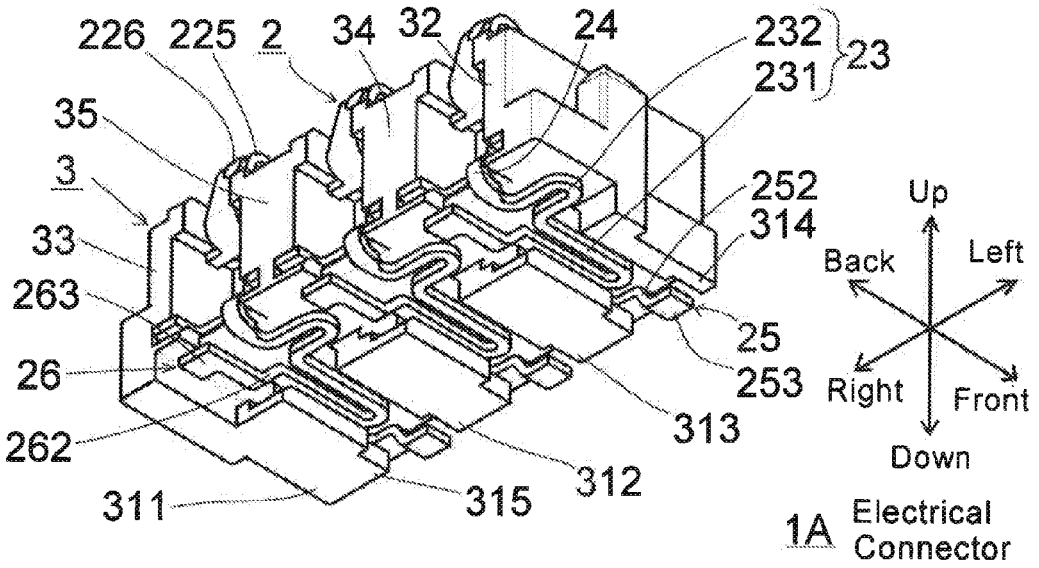
FIG. 16 is a perspective view (part two) of the electrical connector 1.

FIG. 14 is a right-side cross-sectional view of an electrical connector 1A according to a second embodiment of the present invention. FIGS. 15 and 16 are perspective views of the electrical connector 1A. The electrical connector 1A is the same as the first embodiment except that a contact portion 226 of the contact member 2 faces upward. Specifically, the contact-side elastic portion 22 has a shape extending backward and upward from the folding portion 221 at the front end of the basal portion 21 and folded back downward at a folding portion 225 on the rear side. A contact portion 226 convexed toward the upper side and facing upward is formed on the folding portion 225 by press working, for example. If an electrode of the object to be connected is pressed against the contact portion 226 from the upper side, the contact portion 226 is retracted due to elastic deformation of the contact-side elastic portion 22. The housing 3 has a groove portion 39 allowing the contact portion 226 to project in the ceiling portion 36. This embodiment can produce the same effects as the first embodiment.

Described above is an explanation based on the embodiment. The description of the embodiments is illustrative in nature and various variations in constituting elements and processes involved are possible. Those skilled in the art would readily appreciate that such variations are also within the scope of the present invention.

The mounting method of the electrical connector is not limited to surface mounting and may be through-hole mounting.

The number of the contact members 2 attached to the single housing 3 is not limited to three and may appropriately be designed depending on required specifications etc.

EXPLANATIONS OF LETTERS OR NUMERALS

1 Electrical connector
2 Contact member
21 Basal portion
22 Contact-side elastic portion
224 Contact portion
23 Mounting-side elastic portion
24 Folding-back portion
25 First connecting leg portion
251 Stored portion
252 First bent-up portion
253 First surface mounting portion
26 Second connecting leg portion
262 Second bent-up portion
263 Second surface mounting portion
3 Housing
31 Base portion
32,33 Side wall portions
34,35 Partition wall portions
36 Ceiling portion
38 hole portion

The invention claimed is:

1. An electrical connector comprising:
an insulating housing; and
a conductive contact member, wherein,
when a direction toward a mounting object board is downward, the conductive contact member has
a basal portion fixed to the insulating housing,
a contact-side elastic portion rising from the basal portion and having a contact portion,
first and second connecting leg portions having respective tip sides, each of the tip sides acting as a mounting portion for the board at positions different from each other, and
a mounting-side elastic portion disposed between the basal portion and the first and second connecting leg portions, and
the insulating housing has a convex portion located on a lower surface of the insulating housing, wherein
a cover portion facing the lower surface of the insulating housing extends from the convex portion, and
a portion of the first connecting leg portion is located in a gap between the lower surface of the insulating housing and the cover portion.

2. The electrical connector according to claim 1, wherein
the mounting-side elastic portion is present on the lower surface side of the insulating housing, and
the contact member has a folding-back portion located outside of the lower surface of the insulating housing for connecting a first end of the mounting-side elastic portion to the basal portion.

3. The electrical connector according to claim 2, wherein the mounting-side elastic portion has structure displaceable in a front-back direction and a left-right direction without displacement in an up-down direction.

4. The electrical connector according to claim 2, wherein the mounting-side elastic portion has a first U-shaped portion extending in a front-back direction and a second U-shaped portion extending in a left-right direction.

5. The electrical connector according to claim 4, wherein
the insulating housing includes a plurality of the conductive contact members aligned and held in the left-right directions by a partition wall portion interposed therebetween, and
the second U-shaped portion of each of the contact members is shorter than the first U-shaped portion and is located on a rear side, relative to a center position of the insulating housing, in the front-back direction.

6. The electrical connector according to claim 1, wherein
the insulating housing includes a plurality of the conductive contact members aligned and held in a left-right direction by a partition wall portion interposed therebetween, and
the first and second connecting leg portions of each of the conductive contact members have the mounting-side elastic portions for the board separated in a front-back direction.

7. The electrical connector according to claim 1, including
a convex portion on the lower surface of a base portion of the insulating housing, wherein the convex portion comes into contact with the first and second connecting leg portions to restrict elastic deformation of the mounting-side elastic portion.

8. An electrical connector comprising:
an insulating housing; and
a conductive contact member, wherein, when a direction toward a mounting object board is downward, the conductive contact member has
a basal portion fixed to the insulating housing,
a contact-side elastic portion rising from the basal portion and having a contact portion,
a mounting-side elastic portion on the lower surface side of the insulating housing,
a folding-back portion located outside of the lower surface of the insulating housing for connecting a first end of the mounting-side elastic portion to the basal portion, and
first and second connecting leg portions having respective tip sides, each of the first and second connecting leg portions extending downward from a second end of the mounting-side elastic portion, wherein each of the tip sides of the first and second connecting leg portions acts as a mounting portion for the board at positions different from each other.

9. The electrical connector according to claims 8, wherein the mounting-side elastic portion has structure displaceable in a front-back direction and a left-right direction without displacement in an up-down direction.

10. The electrical connector according to claim 8, wherein the mounting-side elastic portion has a first U-shaped portion extending in a front-back direction and a second U-shaped portion extending in a left-right direction.

11. The electrical connector according to claim 10, wherein
the insulating housing includes a plurality of the conductive contact members aligned and held in the left-right direction by a partition wall portion interposed therebetween, and
the second U-shaped portion of each of the contact members is shorter than the first U-shaped portion and is located on a rear side, relative to a center position of the insulating housing, in the front-back direction.

12. The electrical connector according to claim 8, wherein the insulating housing includes a plurality of the conductive contact members aligned and held in a left-right direction by a partition wall portion interposed therebetween, and the first and second connecting leg portions of each of the conductive contact members have the mounting-side elastic portions for the board separated in a front-back direction.

13. The electrical connector according to claim 8, including a convex portion on the lower surface of a base portion of the insulating housing, wherein the convex portion comes into contact with the first and second connecting leg portions to restrict elastic deformation of the mounting-side elastic portion.

* * * * *